US005857296A

United States Patent [19]

Niday et al.

[11] Patent Number: 5,857,296

[45] Date of Patent: Jan. 12, 1999

[54] CONCRETE SANDWICH PANEL ERECTION ANCHOR

[75] Inventors: David Andrew Niday; Roy Lee Edgar, both of Springboro, Ohio

[73] Assignee: Dayton Superior Corporation, Miamisburg, Ohio

[21] Appl. No.: 857,641

[22] Filed: May 16, 1997

Related U.S. Application Data

[60] Provisional application No. 60/017,571 May 16, 1996.

[51] Int. Cl.[6] ..... E02D 35/00

[52] U.S. Cl. ..... 52/125.1; 52/125.2; 52/125.4; 52/309.9

[58] Field of Search ..... 52/122.1, 125.1, 52/125.2, 125.3, 125.4, 125.5, 309.9, 698, 712, 715

[56] References Cited

U.S. PATENT DOCUMENTS

| | | | |
|---|---|---|---|
| 2,886,370 | 5/1959 | Liebert | 52/125.3 X |
| 3,861,106 | 1/1975 | Erhart . | |
| 4,014,151 | 3/1977 | Erhart | 52/125.3 |
| 4,386,486 | 6/1983 | Holt et al. | 52/125.5 |
| 4,702,045 | 10/1987 | Fricker | 52/125.4 |
| 4,769,960 | 9/1988 | Zipf et al. | 52/125.2 X |
| 5,042,219 | 8/1991 | Fricker | 52/712 X |
| 5,197,255 | 3/1993 | Fricker . | |
| 5,469,675 | 11/1995 | Aerton . | |
| 5,596,846 | 1/1997 | Kelly | 52/125.3 X |

OTHER PUBLICATIONS

Dayton Superior Corporation, Tilt–Up Construction Handbook, pp. 30–35 (1990).

Dayton Superior Corporation, Precast–Prestressed Concrete Handbook, pp. 22–48 (1994).

*Primary Examiner*—Carl D. Friedman
*Assistant Examiner*—Kevin D. Wilkens
*Attorney, Agent, or Firm*—Biebel & French

[57] ABSTRACT

An anchor adapted for being embedded within a concrete sandwich panel to facilitate lifting thereof is disclosed. The anchor includes a neck supporting a head adapted for mating with a conventional lifting assembly. The neck is supported on a body portion adapted for being at least partially embedded within the sandwich panel. The body portion includes a pair of opposing wings extending radially outwardly from a central axis wherein each wing includes an inner portion adapted to be embedded within a wythe of insulation and an outer portion adapted to be embedded within a wythe of concrete.

18 Claims, 15 Drawing Sheets

CONCRETE SANDWICH PANEL ERECTION ANCHOR

CROSS-REFERENCE TO RELATED APPLICATION

This application claims the benefit of U.S. Provisional Application No. 60/017,571, filed May 16, 1996.

BACKGROUND OF THE INVENTION

1. Field of the Invention

The present invention relates to the fabrication and handling of precast concrete panels. More particularly, the invention is directed to anchors designed to be embedded in concrete sandwich panels when the panels are formed.

2. Description of the Prior Art

Precast concrete construction includes the plant prefabrication of concrete wall panels. Tilt-up construction is a job-site form of precast concrete construction involving the prefabrication of concrete wall panels on either a building floor slab or a temporary casting slab. Anchors are commonly used in both plant and job-site concrete wall panel fabrication, whereby lifting hardware is used to grasp an anchor embedded in each concrete panel and lift the panel from horizontal to a vertical position. The panel is then carried by a mobile crane to its final position where it is temporarily braced until tied into a roof and floor system to become an integral part of the completed structure.

One type of panel finding increasing use in tilt-up construction is the concrete sandwich panel, a composite panel of two relatively thin outer concrete wythes or layers and an inner insulation wythe or layer located between the concrete wythes. The placement of the insulation between the two concrete wythes protects the insulation from damage and reduces both the construction and maintenance costs of the completed structure.

A disadvantage of conventional anchors is that they are not suitable for use in concrete sandwich panels, since such prior art anchors cannot be properly retained within the insulation layer, resulting in the dangerous condition of the anchor being pulled from the sandwich panel upon lifting. Further, placement of prior art anchors within the concrete of the sandwich panel typically results in the spalling or fracturing of the relatively thin concrete wythes.

Accordingly, there is a need for an anchor which is adapted for use with a concrete sandwich panel. More particularly, there is a need for an anchor which is adapted for being securely retained within a concrete sandwich panel to facilitate lifting thereof without damaging the outer concrete wythes.

SUMMARY OF THE INVENTION

The present invention provides an anchor which is adapted for use with a concrete sandwich panel having an inner insulation wythe or layer between a pair of outer concrete wythes or layers. The anchor comprises a body portion including a pair of opposing wings. A head is supported on the body portion by a neck, both the head and neck being centrally located between the wings. Each of the opposing wings includes an inner portion intersecting a central axis defined by the neck, and an outer portion extending radially outwardly from the inner portion.

In use, the body portion spans the insulation wythe such that each of the wings is partially embedded in a concrete wythe, thereby providing for the stability of the anchor.

More particularly, the inner portion of each wing is adapted to be embedded within the insulation wythe and the outer portion of each wing is adapted to be embedded within one of concrete wythes. The head is adapted for mating with a lifting assembly whereby the lifting assembly is enabled to lift the panel from a horizontal to a vertical position. In addition, each of the wings includes an aperture for receiving an elongated member, preferably a piece of rebar, to facilitate retaining the anchor in the concrete wythes by development of the required reaction forces during lifting of the sandwich panel.

Therefore, it is an object of the present invention to provide an anchor for facilitating the lifting of a concrete sandwich panel.

It is a further object of the present invention to provide such an anchor adapted for being securely retained within the concrete wythes of a concrete sandwich panel.

Yet another object of the present invention is to provide such an anchor to facilitate lifting of a concrete sandwich panel without damaging the concrete wythes.

Other objects and advantages of the invention will be apparent from the following description, the accompanying drawings and the appended claims.

DETAILED DESCRIPTION OF THE PREFERRED EMBODIMENTS

Figure 1:
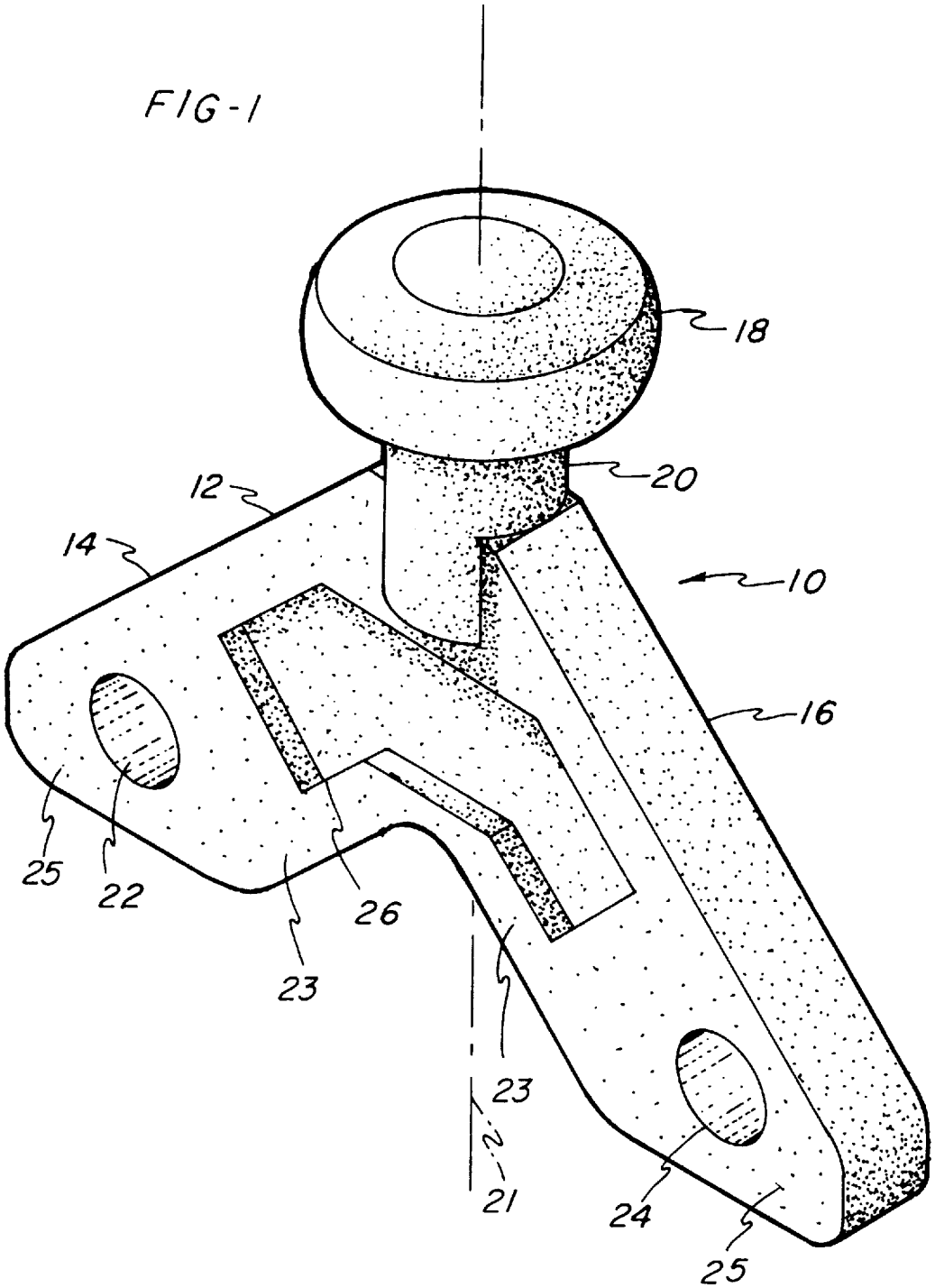
FIG. 1 is an isometric view of an anchor of the present invention.
Figure 2:
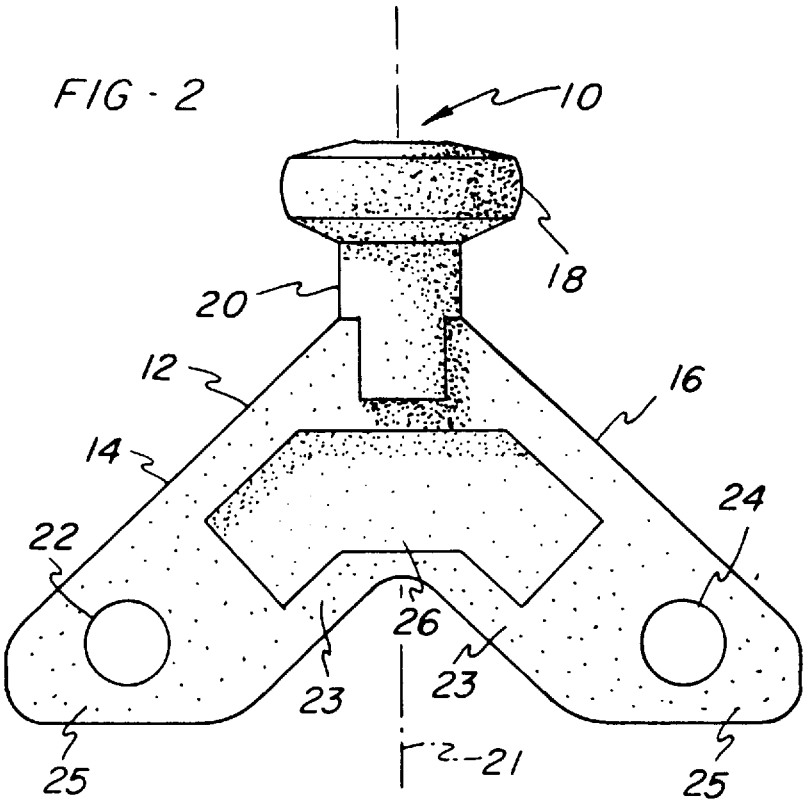
FIG. 2 is a front elevational view of the anchor of FIG. 1.
Figure 3:
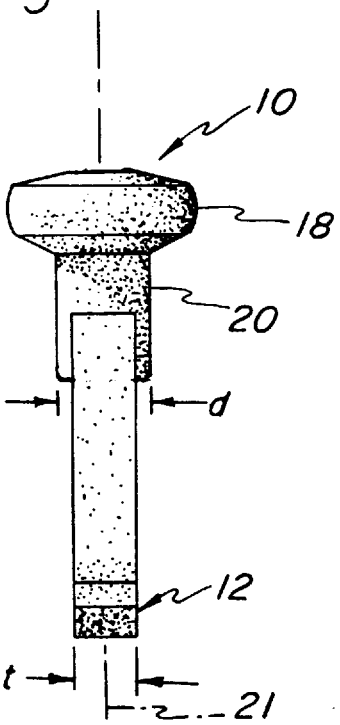
FIG. 3 is a side elevational view of the anchor of FIG. 1.

Referring initially to FIGS. 1–3, the anchor 10 of the present invention comprises a generally planar body portion 12 of thickness t (FIG. 3) including a pair of opposing wings 14 and 16. A head 18 is supported on the body portion 12 by a cylindrical neck 20 of diameter d (FIG. 3) wherein both the head 18 and neck 20 are formed to mate with a lifting assembly (not shown) which is subsequently connected to a crane sling (not shown) in a manner as is well known in the art. The lifting assembly is of conventional design and may comprise the P-51 SL lifting eye, available from the Dayton Superior Corporation of Dayton, Ohio. The head 18 and neck 20 are centrally located between the wings 14 and 16 wherein the neck 20 defines a central axis 21. The diameter d of neck 20 is preferably at least as great as the thickness t of body portion 12, as illustrated by FIG. 3, such that the neck 20 has a sufficient cross sectional area to adequately support forces transferred between the body portion 12 and head 18.

The wings 14 and 16 extend radially outwardly from the central axis 21 in a parallel relationship with each other to define the planar body portion 12. More specifically, each wing 14 and 16 includes an inner portion 23 intersecting the central axis 21 and an outer portion 25 extending radially outwardly from the inner portion 23. Apertures 22 and 24 are located near a lower extremity of the outer portion 25 of each wing 14 and 16, respectively. A recess 26 may be formed in the body portion 12 extending between the wings 14 and 16 in order to reduce the total weight of the anchor 10.

Figure 4:
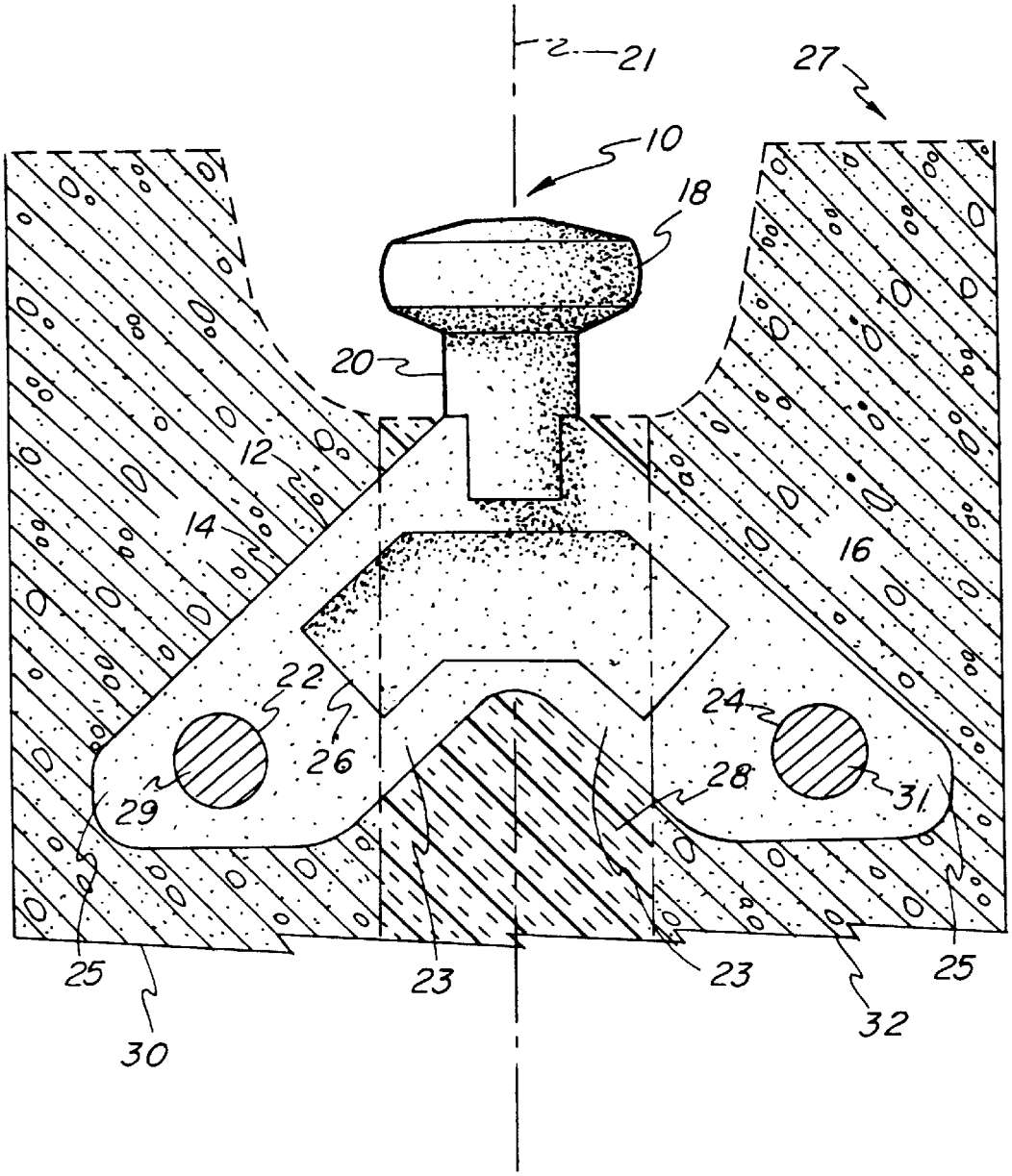
FIG. 4 is a front elevational view, in partial section, showing the anchor of FIG. 1 embedded in a concrete sandwich panel.

In use, the anchor 10 is installed in the form work for constructing a concrete sandwich panel 27 as illustrated in FIG. 4. Separate elongated members, preferably rebar 29 and 31, are inserted through each of the apertures 22 and 24, respectively. Subsequently, the anchor 10 is cast into an inner insulation wythe or layer 28 separating a pair of outer concrete wythes or layers 30 and 32.

FIG. 4 illustrates the anchor 10 of FIGS. 1–3 embedded in the edge of the concrete sandwich panel 27. The anchor 10 spans the insulation wythe 28, with each wing 14 and 16 partially embedded in the concrete wythes 30 and 32, respectively. The inner portion 23 of each wing 14 and 16 is embedded substantially within the insulation wythe 28, while the outer portion 25 of each wing 14 and 16 is embedded substantially within one of the concrete wythes 30 and 32. The head 18 and neck 20 are coaxial with the axis 21 and centrally located above the insulation layer 28.

Figure 5:
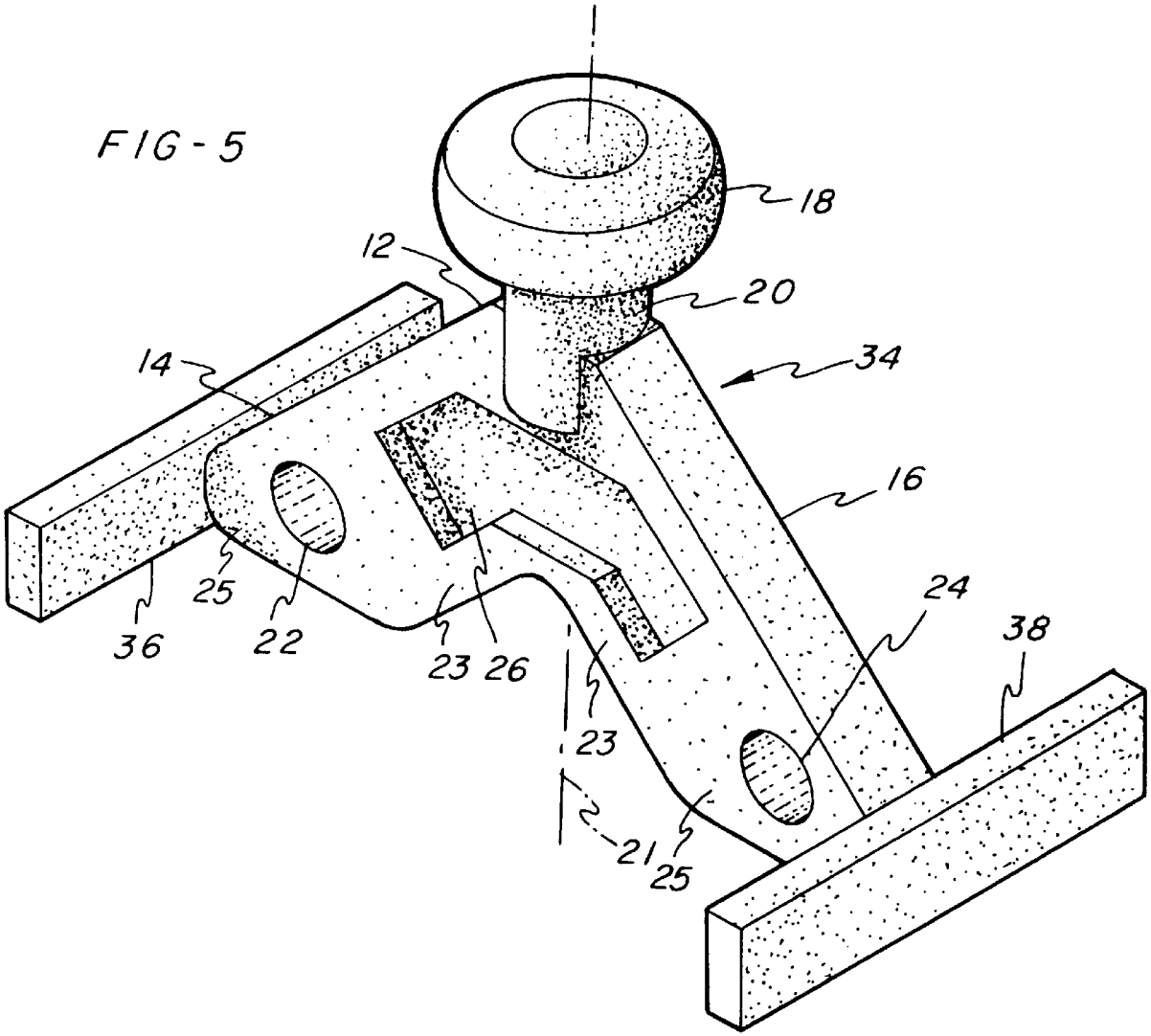
FIG. 5 is an isometric view of an alternative embodiment of the anchor of the present invention.
Figure 6:
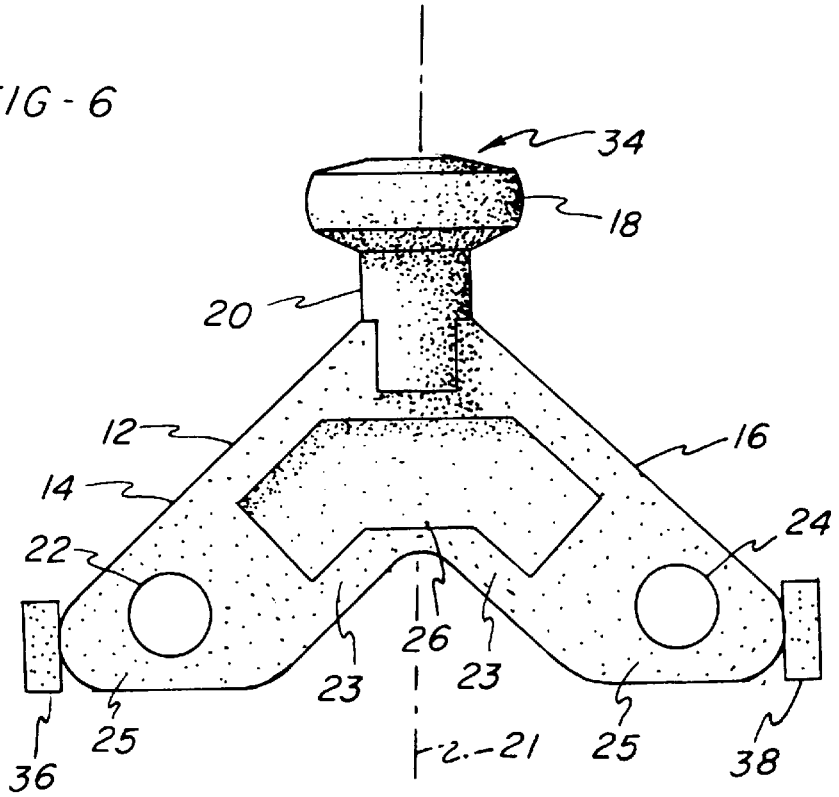
FIG. 6 is a front elevational view of the anchor of FIG. 5.
Figure 7:
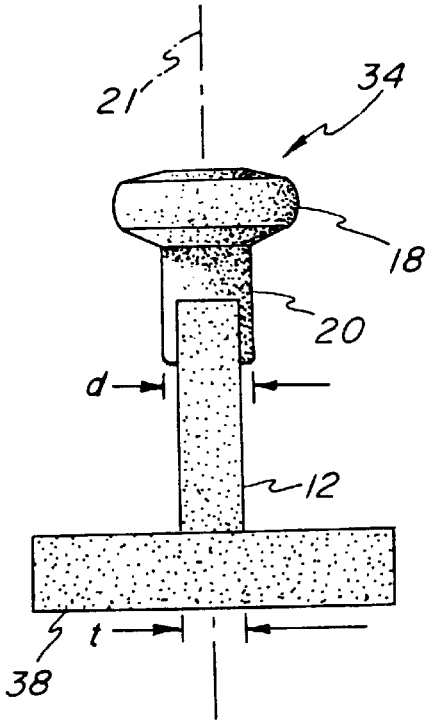
FIG. 7 is a side elevational view of the anchor of FIG. 5.

An alternative embodiment of the anchor of FIGS. 1–4 is illustrated in FIGS. 5–7. The anchor 34 of this embodiment is substantially similar to the anchor 10 of FIGS. 1–4, and includes all the elements of anchor 10 as identified with the same reference numerals. The anchor 34 further includes shear plates 36 and 38 located on outside edges of the outer portions 25 of the wings 14 and 16, respectively. The shear plates 36 and 38 extend perpendicular to the body portion 12 as defined by the parallel opposing wings 14 and 16 and are adapted to be located within the concrete wythes 30 and 32, respectively. The shear plates 36 and 38 increase the surface area of the anchor 34 embedded within the concrete wythes 30 and 32 thereby improving the shear load capacity of the anchor 34 by applying any resulting forces or loads over a larger area of concrete within the wythes 30 and 32.

Figure 8:
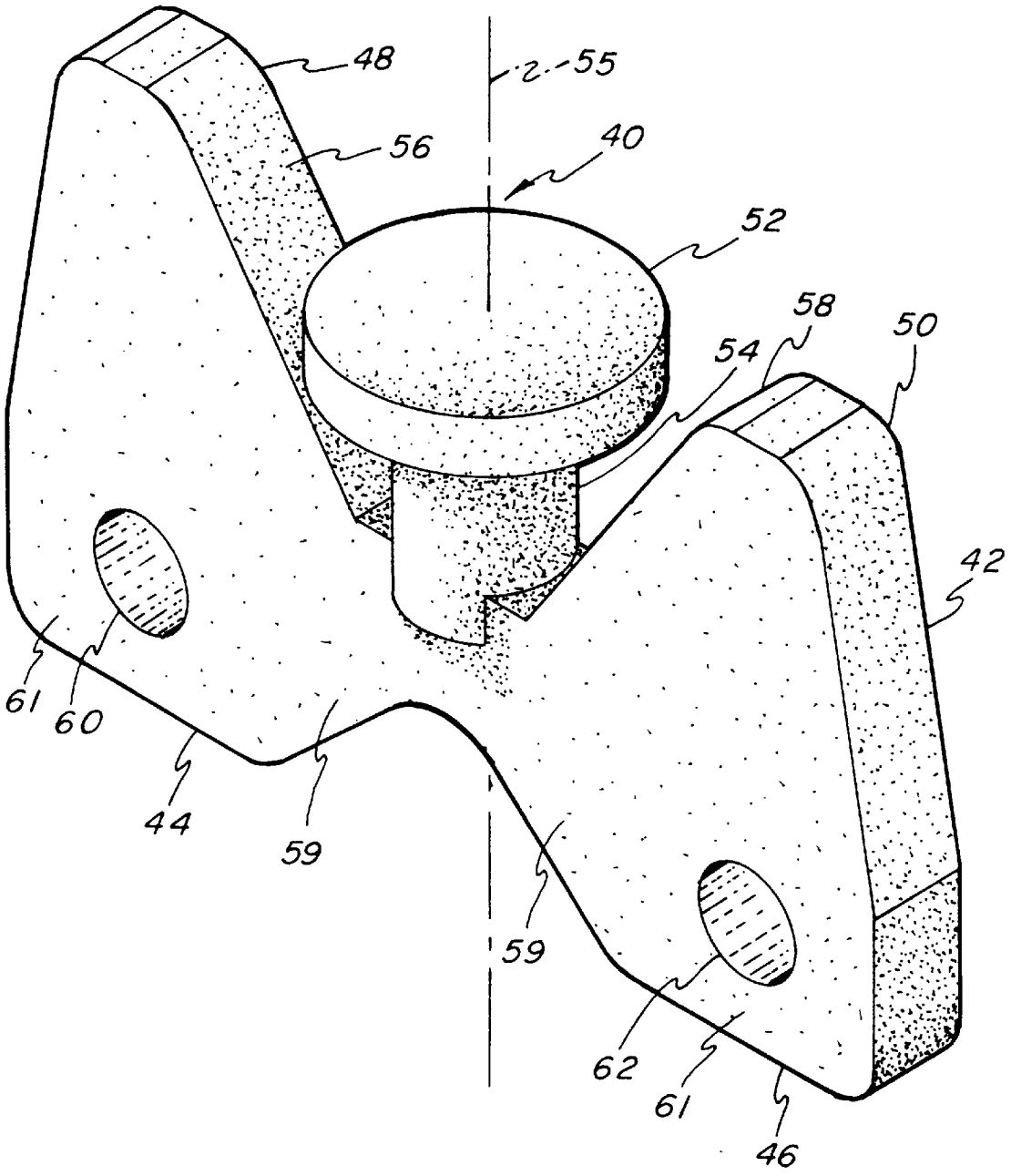
FIG. 8 is an isometric view of an alternative embodiment of the anchor of the present invention.
Figure 9:
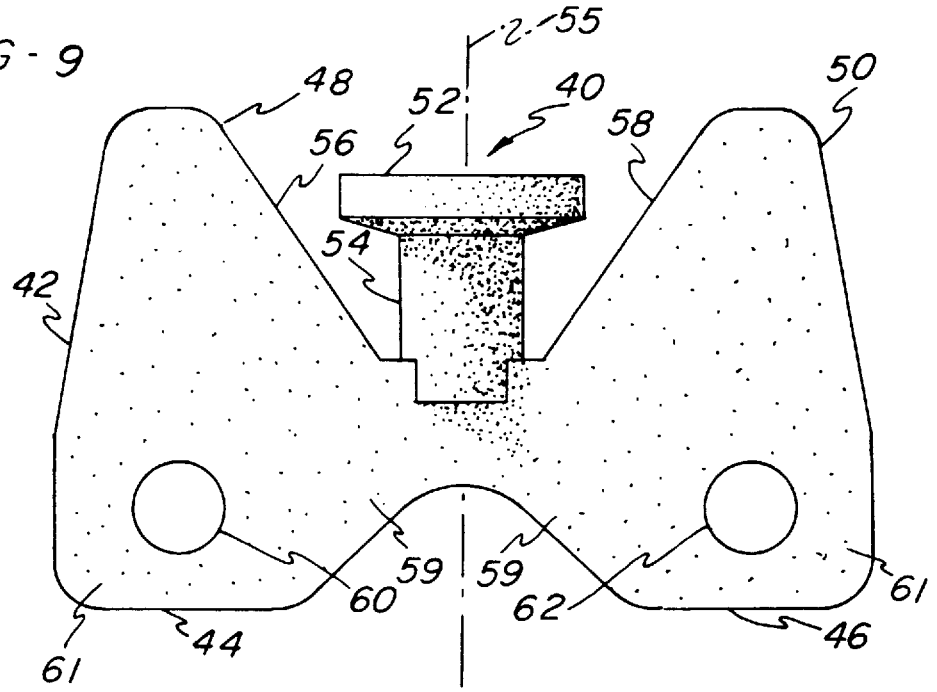
FIG. 9 is a front elevational view of the anchor of FIG. 8.
Figure 10:
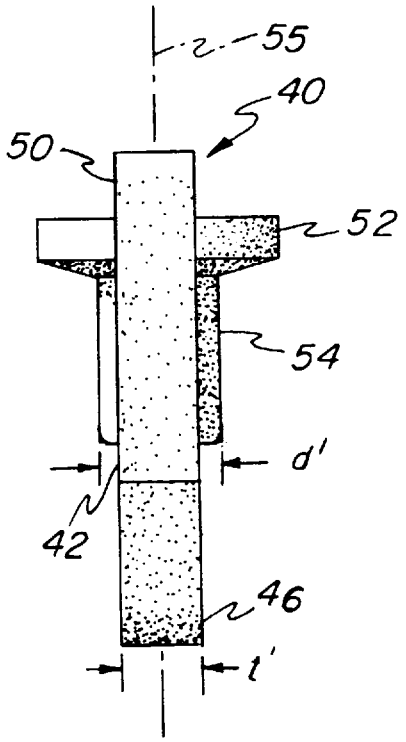
FIG. 10 is a side elevational view of the anchor of FIG. 8.

A further embodiment of the anchor of the present invention is shown in FIGS. 8–10. Anchor 40 comprises a generally planar body portion 42 of thickness $t^1$ (FIG. 10) including a pair of opposing wings 44 and 46 having upper portions 48 and 50. A head 52 is supported on the body portion 42 by a cylindrical neck 54 of diameter d' (FIG. 10) wherein both the head 52 and neck 54 are formed to mate with a conventional lifting assembly (not shown) for connection to a crane sling (not shown) in a manner as is well known in the art. The head 52 and neck 54 are centrally located between the wings 44 and 46 wherein the neck 54 defines a central axis 55. The upper portions 48 and 50 extend upwardly to a level at least equal to the height of the head 52 wherein the upper portions 48 and 50 include bearing surfaces 56 and 58 facing inwardly toward the head 52. The diameter d' of neck 54 is preferably at least as great as the thickness t' of body portion 42, as illustrated by FIG. 10, so that the neck 54 has sufficient strength to support forces exerted by the body portion 42 and head 52.

The wings 44 and 46 extend radially outwardly from the central axis 55 in a parallel relationship with each other to define the planar body portion 42. More particularly, each wing 44 and 46 includes an inner portion 59 intersecting the central axis 55 and an outer portion 61 extending radially outwardly from the inner portion 59. Apertures 60 and 62 are located near a lower extremity of the outer portion 61 of each of the wings 44 and 46, respectively. It should be noted that the apertures 60 and 62 may be located higher within the wings 44 and 46 such that the lower extremity of the wings 44 and 46 may be rounded or clipped thereby reducing the overall weight of the anchor 40.

Figure 11:
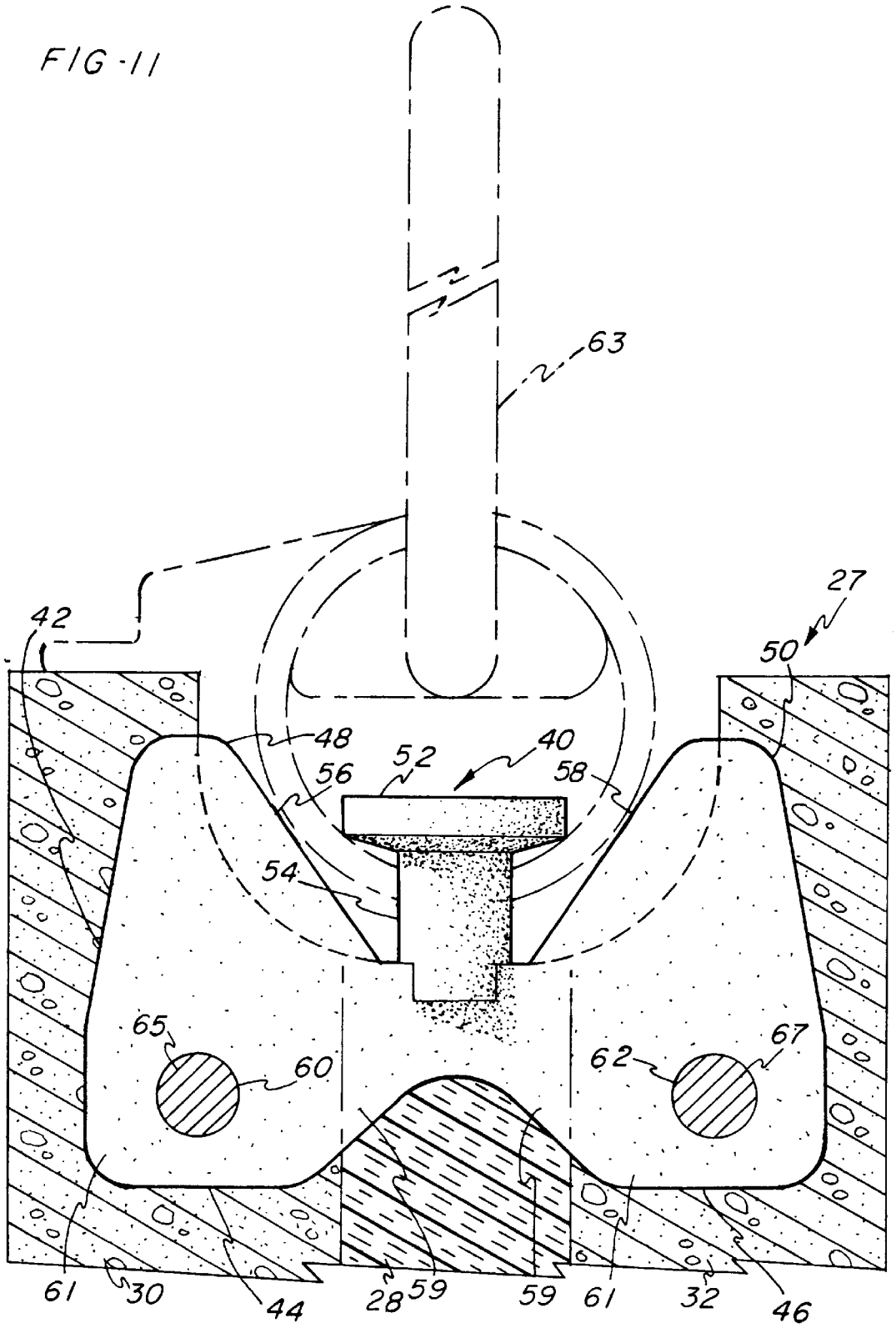
FIG. 11 is a front elevational view, in partial section, showing the anchor of FIG. 8 embedded in a concrete sandwich panel.

In use, the anchor 40 is installed in the form work for constructing the concrete sandwich panel 27 in a manner similar to that described above with respect to the embodiment of FIG. 4. With reference to FIG. 11, pieces of rebar 65 and 67 are inserted through each of the apertures 60 and 62, respectively, and the anchor 40 is then cast into the concrete sandwich panel 27 which is disposed in a horizontal position. In operation, a conventional lifting assembly 63 (FIGS. 11 and 11A) is attached to the head 52 to pull the panel to a vertical position.

Figure 11A:
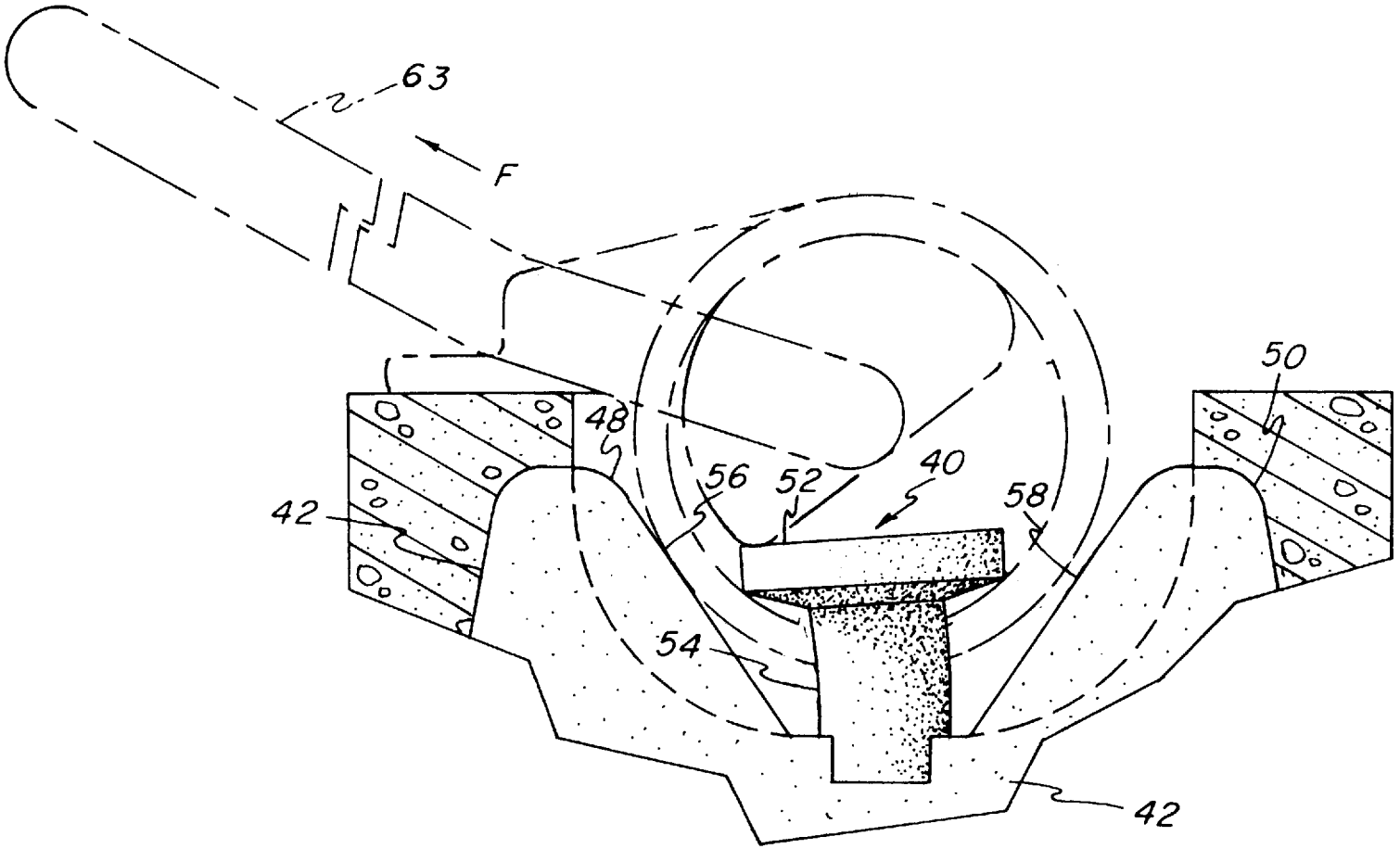
FIG. 11A is a partial detail view of the anchor of FIG. 11 showing the head bending as force is applied by a lifting assembly.

Referring to FIG. 11A, as the lifting assembly 63 applies a lifting force F to the head 52, the neck 54 deflects laterally, thereby permitting the assembly 63 to move into contact with one of the bearing surfaces 56 and 58. In this manner, a portion of the lifting stresses is transferred to the contacting bearing surface 56 or 58 and the respective upper portion 48 or 50 to reduce the stress carried by the head 52 and neck 54. In addition, the local spalling or fracturing that often occurs with the prior art anchors as a result of the force F being applied directly on one of the concrete wythes 30 and 32 is minimized since the anchor 40 distributes the force F throughout the concrete sandwich panel 27 via the body portion 42.

Figure 12:
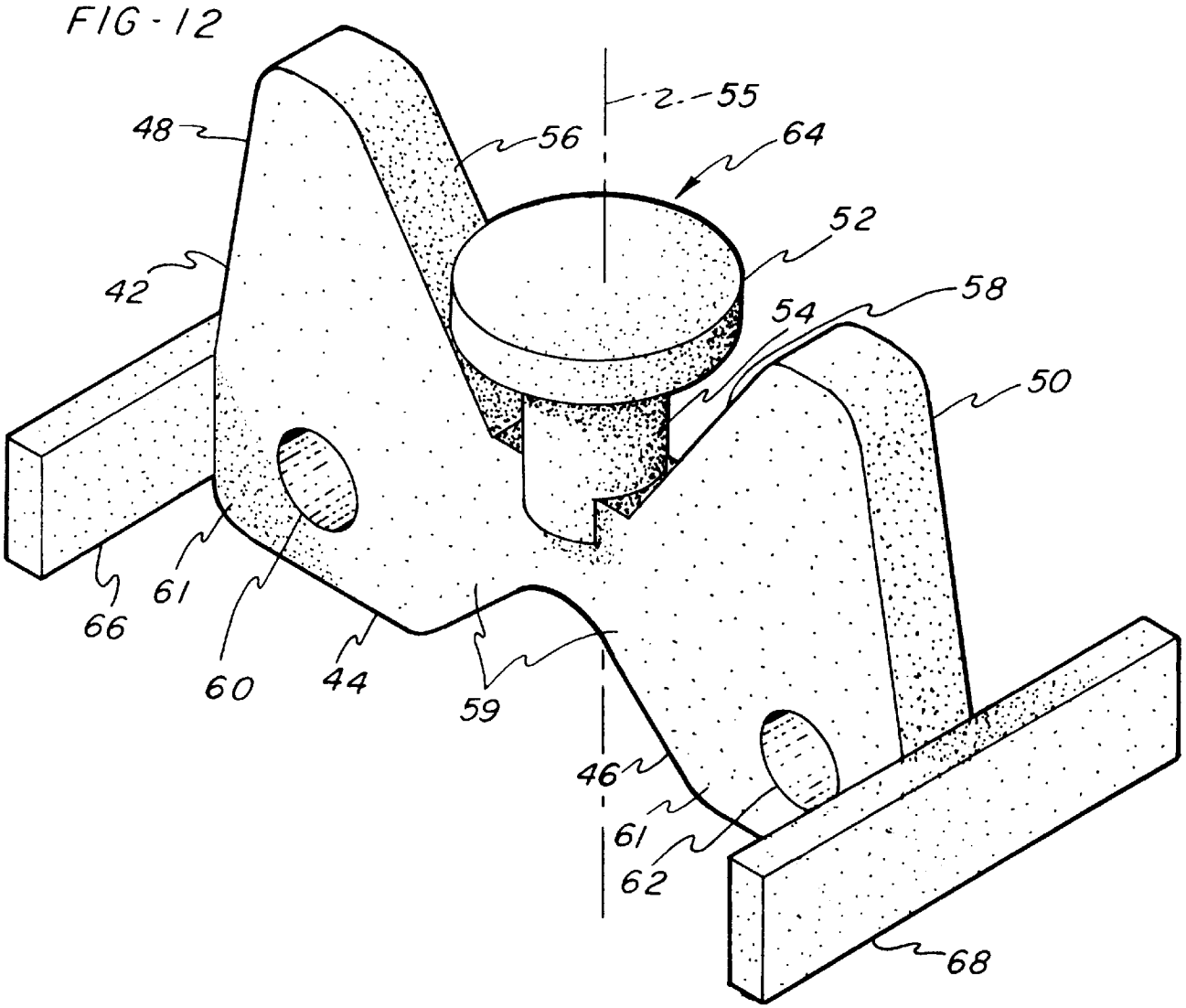
FIG. 12 is an isometric view of an alternative embodiment of the anchor of the present invention.
Figure 13:
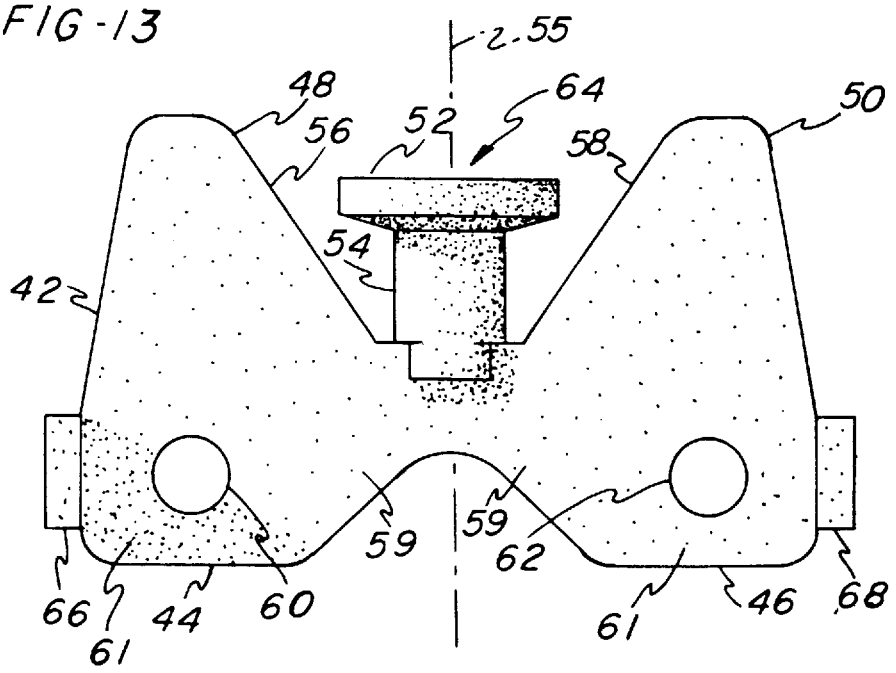
FIG. 13 is a front elevational view of the anchor of FIG. 12.
Figure 14:
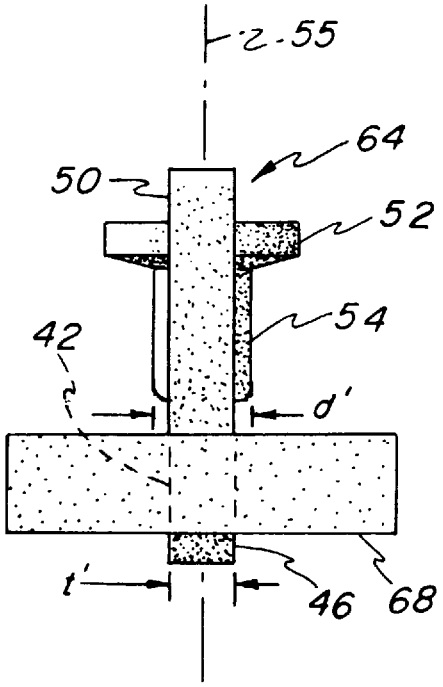
FIG. 14 is a side elevational view of the anchor of FIG. 12.

An alternative embodiment of the anchor of FIGS. 8–10 is illustrated in FIGS. 12–14. The anchor 64 of this embodiment is similar to the anchor 40 of FIGS. 8–10 and includes all of the elements of anchor 40 as identified with the same reference numerals. The anchor 64 further includes shear plates 66 and 68 located on outside edges of the outer portions 61 of the wings 44 and 46, respectively. The shear plates 66 and 68 extend perpendicular to the body portion 42 as defined by the parallel opposing wings, 44 and 46. The shear plates 66 and 68 improve the shear force capacity of the anchor 64 by applying the load over a larger area within the concrete wythes 30 and 32, respectively.

Figure 15:
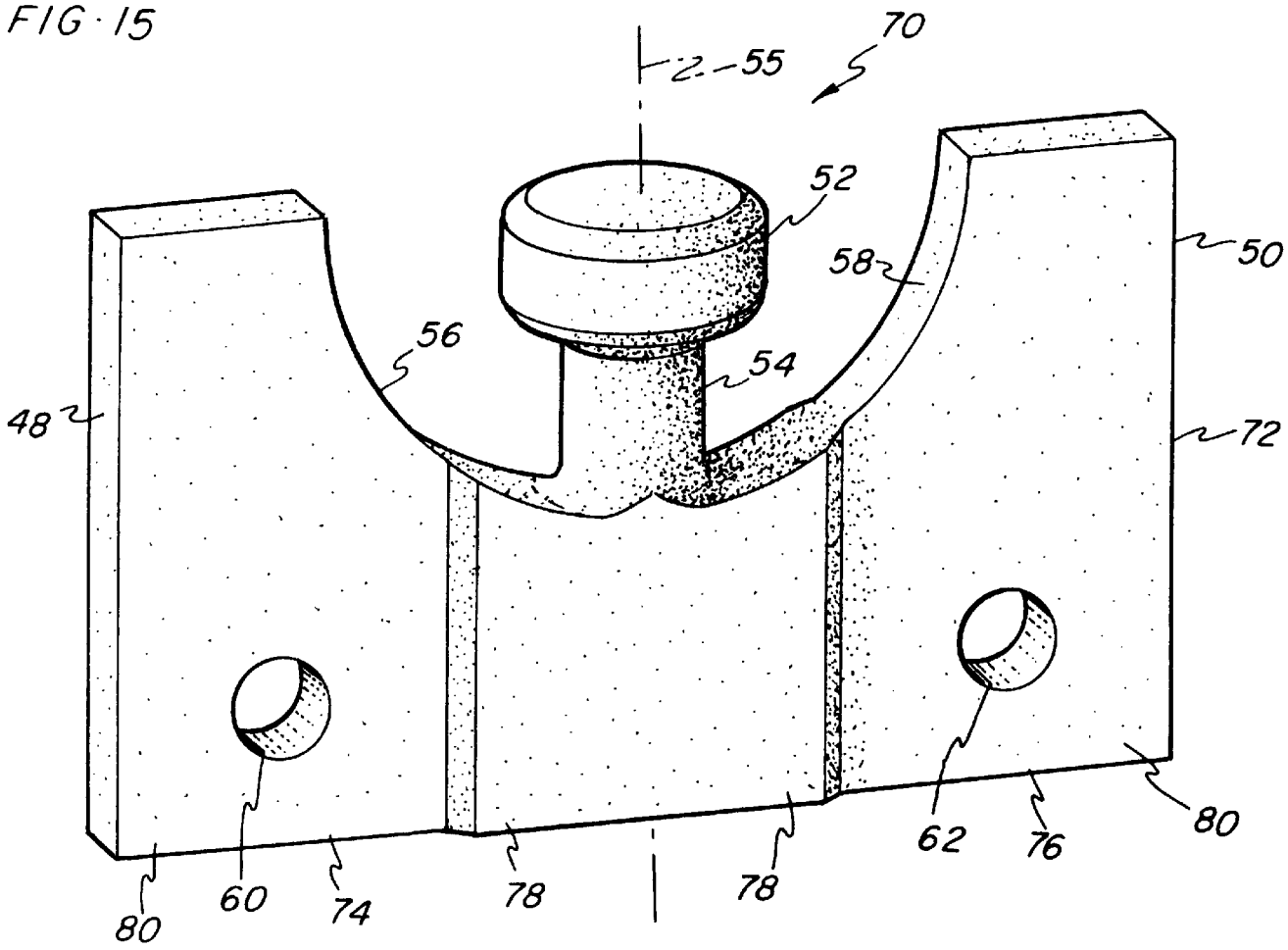
FIG. 15 is a front isometric view of an alternative embodiment of the anchor of the present invention.
Figure 16:
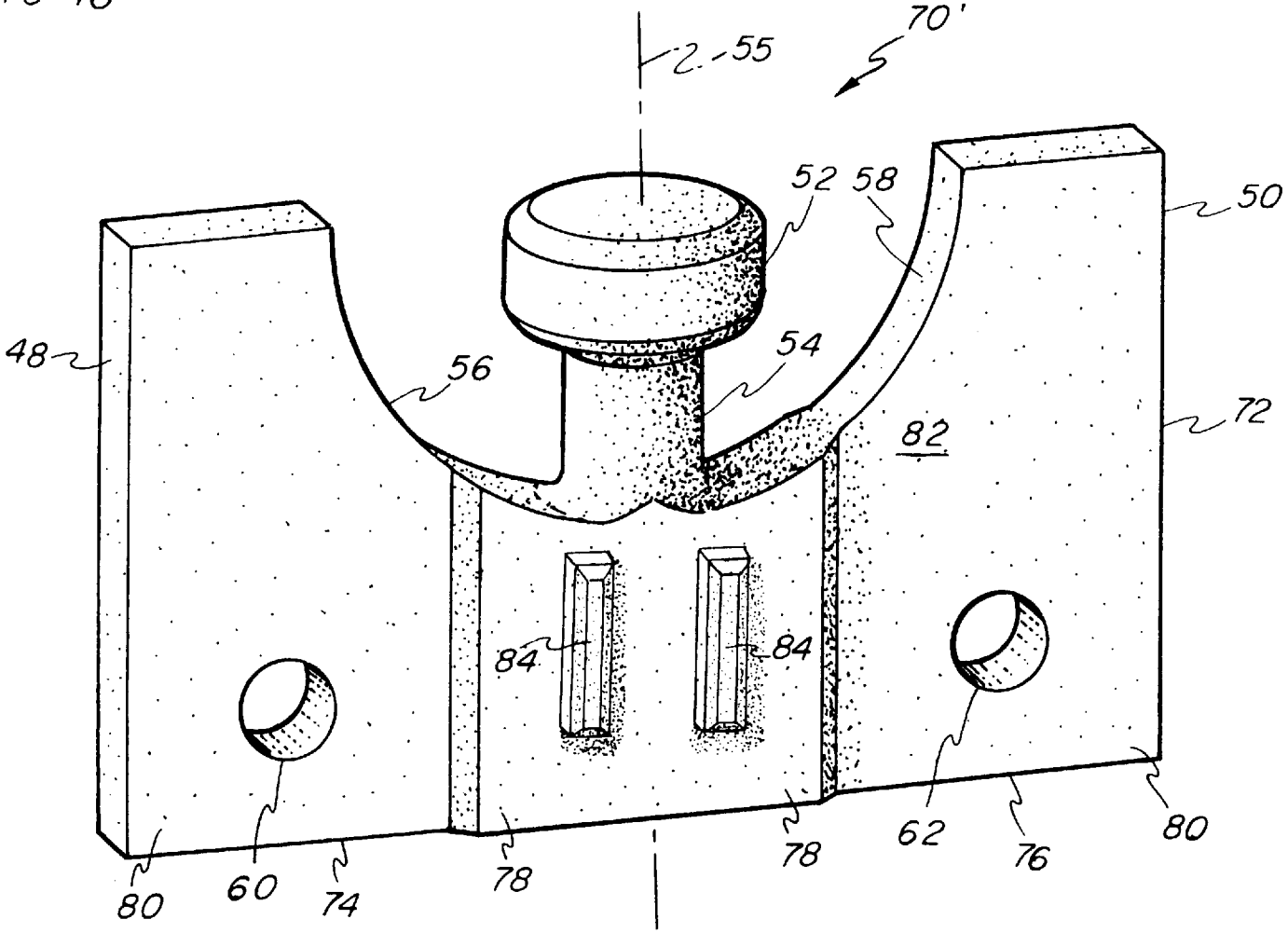
FIG. 16 is a front isometric view of a further embodiment of the anchor of FIG. 15, the side opposite being a mirror image.

Further alternative embodiments of the present invention are illustrated in FIGS. 15 and 16 as anchors 70 and 70', respectively. The anchors 70 and 70' are similar to the embodiment illustrated as anchor 40 in FIGS. 8–10 wherein like components are identified with like reference numerals. Anchors 70 and 70' comprise a generally planar body portion 72 including a pair of opposing wings 74 and 76. Each wing 74 and 76 includes an inner portion 78 intersecting the central axis 55 and an outer portion 80 extending radially outwardly from the inner portion 78. As may be readily observed from FIGS. 15 and 16, the inner portions 78 have an increased thickness compared to the inner portions 59 of the anchor 40 of the embodiment of FIGS. 8–10 thereby providing for improved shear force capacity for the anchors 70 and 70'.

With further reference to FIG. 16 illustrating the anchor 70', the body portion 72 defines a front surface 82 and a rear surface (not shown) which is identical to the front surface 82. A pair of strengthening ribs 84 extend outwardly from each of the front and rear surfaces 82. The ribs 84 are integrally formed with the body portion 72 and are disposed substantially parallel to the central axis 55 as defined by the cylindrical neck 54. The ribs 84 provide added structural strength and rigidity to the anchor 70'. More particularly, the ribs 84 oppose forces acting in a direction perpendicular to the plane defined by the parallel opposing wings 74 and 76 forming the body portion 72.

Figure 17:
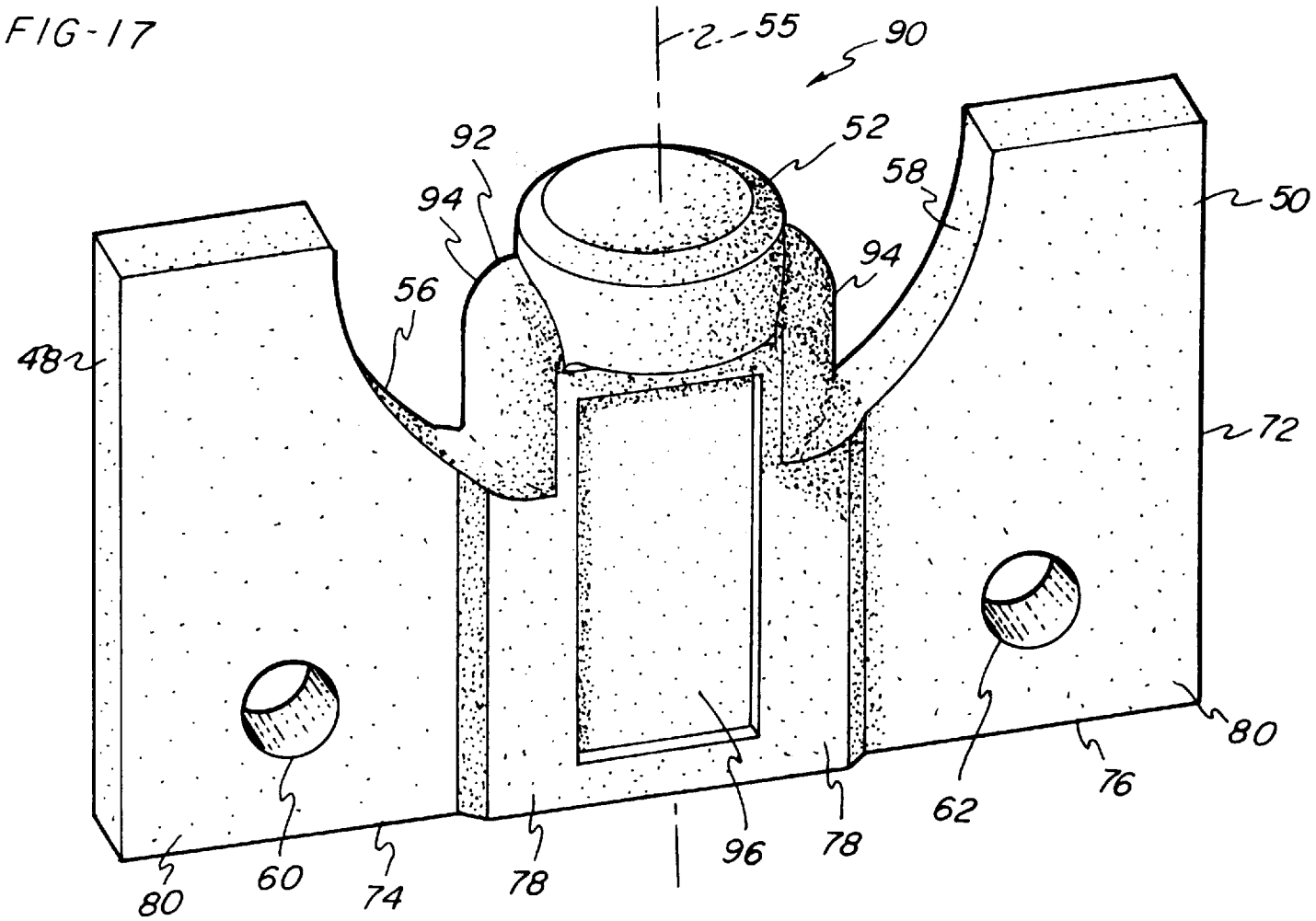
FIG. 17 is a front isometric view of an alternative embodiment of the anchor of the present invention.
Figure 18:
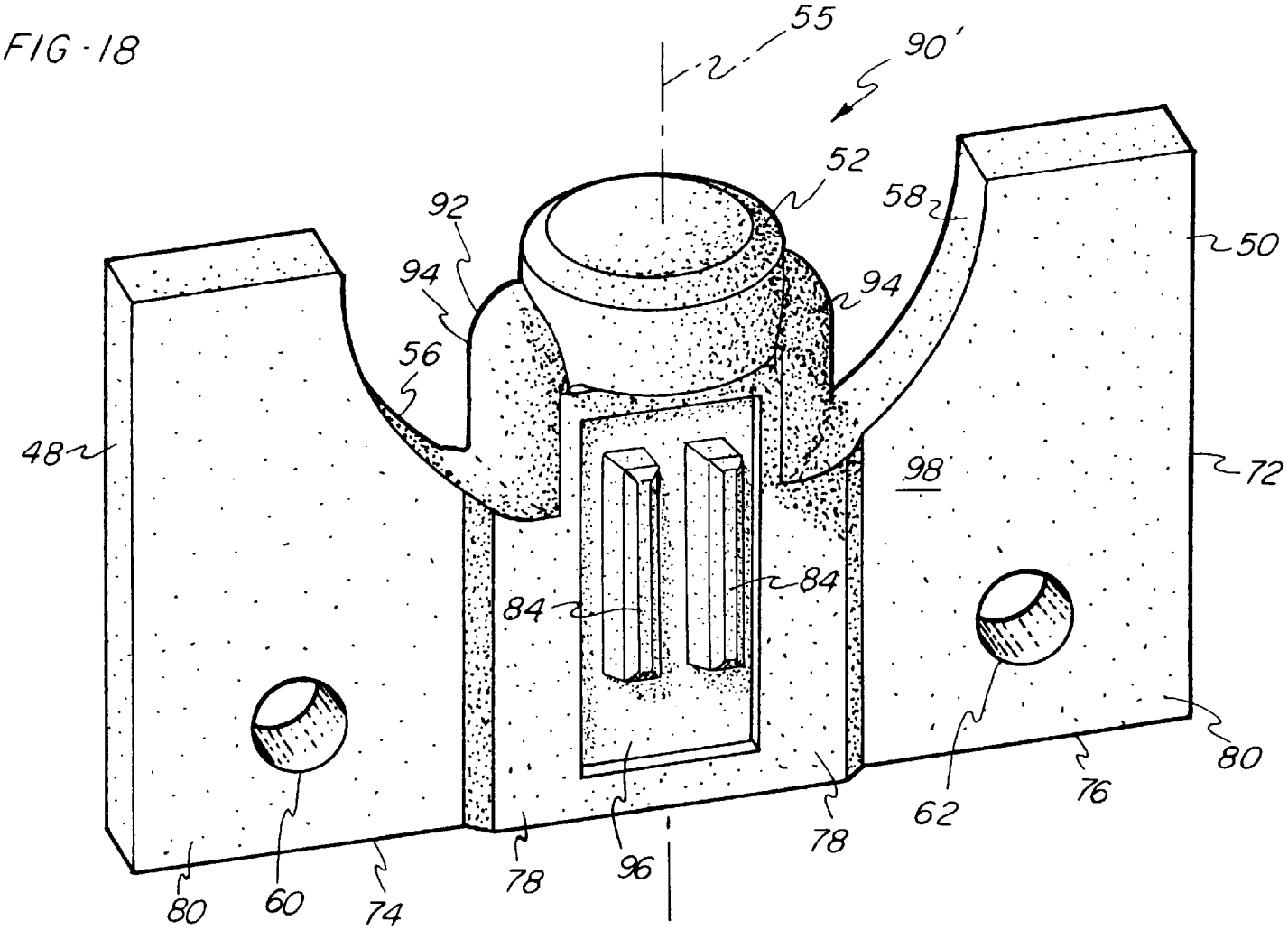
FIG. 18 is a front isometric view of a further embodiment of the anchor of FIG. 17, the side opposite being a mirror image.

Additional alternative embodiments of the present invention are illustrated as anchors 90 and 90' in FIGS. 17 and 18, respectively. The anchors 90 and 90' are substantially similar to the anchors 70 and 70' of FIGS. 15 and 16 wherein like components are identified with like reference numerals. A neck 92 includes a pair of strengthening bosses 94 which extend from the body portion 72 to the head 52 hereby adding structural strength and rigidity to the neck 92. A recessed portion 96 is centrally located within the body portion 72 and facilitates the positioning of a plug (not shown) used to cover the head 52 and neck 92 during the casting of the concrete sandwich panel around the anchor 90 and 90'.

Referring further to FIG. 18, the body portion 72 of the anchor 90' further includes a front surface 98 and a rear surface (not shown) which is identical to the front surface 98. A pair of strengthening ribs 84 extend outwardly from each of the front and rear surfaces 98 in a manner similar with respect to the anchors 70 and 70' of FIGS. 16 and 17 as described above.

From the above description, it should be apparent that the present invention provides an anchor adapted for being securely retained within a concrete sandwich panel to facilitate lifting thereof without damaging the concrete wythes.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An anchor for a concrete panel, said anchor comprising:

a head adapted for mating with a lifting assembly;

a neck supporting said head and defining a central axis;

a body portion adapted for being at least partially embedded within the concrete panel, said body portion including a pair of opposing wings extending radially outwardly from said central axis; and wherein at least one of said opposing wings includes at least one aperture for receiving an elongated member.

2. The anchor of claim 1 wherein the concrete panel includes a pair of concrete layers and an insulation layer between the concrete layers, each of said opposing wings including an inner portion intersecting said central axis and an outer portion extending radially outwardly from said inner portion, each said inner portion adapted to be embedded within the insulation layer and each said outer portion adapted to be embedded within one of the concrete layers.

3. The anchor of claim 1 wherein said body portion further includes a weight reducing recessed portion.

4. The anchor of claim 1 wherein said neck has a predetermined diameter and said body has a predetermined thickness, said diameter of said neck at least as great as said thickness of said body.

5. The anchor of claim 1 further comprising at least one shear plate supported by at least one of said opposing wings.

6. The anchor of claim 1 wherein said neck includes a pair of strengthening bosses extending from said body portion to said head.

7. The anchor of claim 1 wherein each of said opposing wings further include an upper portion extending toward said head.

8. The anchor of claim 7 wherein said upper portion each includes a bearing surface facing said head.

9. The anchor of claim 1 wherein said body portion further includes front and rear surfaces and at least one strengthening rib extending outwardly from each of said front and rear surfaces.

10. The anchor of claim 9 wherein each of said strengthening ribs is disposed substantially parallel to said central axis.

11. An anchor for a concrete panel, said anchor comprising:

a head adapted for mating with a lifting assembly;

a neck supporting said head and defining a central axis;

a body portion adapted for being at least partially embedded within the concrete panel, said body portion including a pair of opposing wings extending radially outwardly from said central axis; and at least one shear plate supported by at least one of said opposing wings.

12. The anchor of claim 11 wherein each of said opposing wings includes at least one aperture for receiving an elongated member.

13. The anchor of claim 11 wherein the concrete panel includes a pair of concrete layers and an insulation layer between the concrete layers, each of said opposing wings including an inner portion intersecting said central axis and an outer portion extending radially outwardly from said inner portion, each said inner portion adapted to be embedded within the insulation layer and each said outer portion adapted to be embedded within one of the concrete layers.

14. The anchor of claim 11 wherein said neck has a predetermined diameter and said body has a predetermined thickness, said diameter of said neck at least as great as said thickness of said body.

15. The anchor of claim 11 wherein each of said opposing wings further includes an upper portion extending toward said head, each said upper portion including a bearing surface facing said head.

16. An anchor for a concrete sandwich panel having a pair of concrete layers and an insulation layer between the concrete layers, said anchor comprising:

a head adapted for mating with a lifting assembly;

a neck supporting said head and defining a central axis, said neck having a predetermined diameter;

a body portion including a pair of opposing wings;

each of said opposing wings having an inner portion intersecting said central axis, an outer portion extending radially outwardly from said inner portion and an upper portion extending toward said head, each said upper portion including a bearing surface facing said head; and wherein each said inner portion is adapted to be embedded within the insulation layer and each said outer portion is adapted to be embedded within one of the concrete layers, each said outer portion including at least one aperture for receiving an elongated member.

17. An anchor in combination with a concrete sandwich panel including a pair of concrete layers and an insulation layer between the concrete layers, said anchor comprising:

a head adapted for mating with a lifting assembly;

a neck supporting said head and defining a central axis;

a body portion including a pair of opposing wings extending radially outwardly from said central axis; and wherein each of said opposing wings includes an outer portion embedded within one of said concrete layers of said concrete sandwich panel.

18. The anchor of claim 17 wherein each of said opposing wings further includes an inner portion extending radially inwardly from said outer portion, each said inner portion embedded within said insulation layer of said concrete sandwich panel.

* * * * *